US007114829B2

(12) United States Patent
Lai

(10) Patent No.: US 7,114,829 B2
(45) Date of Patent: Oct. 3, 2006

(54) MULTI-FACET FULL COLOR ILLUMINATOR

(76) Inventor: Wen-Cheng Lai, A1, 12F, No. 129, Hsin-Nan Rd., Lu-Chu Township, Taoyuan Hsien (TW)

( * ) Notice: Subject to any disclaimer, the term of this patent is extended or adjusted under 35 U.S.C. 154(b) by 100 days.

(21) Appl. No.: 11/001,861

(22) Filed: Dec. 1, 2004

(65) Prior Publication Data

US 2006/0114672 A1 Jun. 1, 2006

(51) Int. Cl.
*F21V 9/00* (2006.01)
*A63F 3/00* (2006.01)

(52) U.S. Cl. ..... 362/231; 362/240; 362/252; 362/295; 40/444; 273/237

(58) Field of Classification Search ..... 362/231, 362/240, 252, 295; 273/237; 40/444
See application file for complete search history.

(56) References Cited

U.S. PATENT DOCUMENTS 3,747,931 A * 7/1973 Tuan ..... 273/237
3,805,049 A * 4/1974 Frank et al. ..... 40/444

* cited by examiner

*Primary Examiner*—Sandra O'Shea
*Assistant Examiner*—James W Cranson, Jr.

(57) ABSTRACT

A multi-facet full color illuminator is provided, including a case, a plurality of separated areas inside the case, a plurality of separators for forming separated areas and each separator being shared by two adjacent separated areas, a light source module inside each separated area, each light source module having at least two elements capable of emitting different colors of light, and a controller for adjusting the electric current to control the brightness of each light source module. By using the controller to adjust the electric current, a facet can display light of various color and brightness. This, combined with other facets can create more varieties of light patterns.

5 Claims, 6 Drawing Sheets

MULTI-FACET FULL COLOR ILLUMINATOR

FIELD OF THE INVENTION

The present invention generally relates to a multi-facet full color illuminator, and more specifically to a multi-facet illuminator that is capable of independently generating different color lights on all or some of its facets to achieve the different illumination effects.

BACKGROUND OF THE INVENTION

The conventional design of cups used in illuminators is usually uni-directional with a single light source or uni-directional with multiple light sources. This conventional design makes it difficult to integrate a plurality of cups in an illuminator for illuminating in different directions because the limits imposed by the cup space and the uni-direction light source. When the emitting angle of the light source is different from the source that the cup is designed for, a gap called light-less turning zone is generated where no light can reach. In addition, the conventional multi-facet decorative illuminator can only display the same color light in all its facets.

SUMMARY OF THE INVENTION

The present invention has been made to overcome the aforementioned drawback of a conventional multi-facet illuminator. The primary object of the present invention is to provide a multi-facet full color illuminator free of light-less turning zones. The illuminator of the present invention uses a transparent multi-facet case so that each facet corresponds to one or more light sources. Through the adjustment of a light controller, each facet can display completely identical, partially identical or completely different color of light. In addition to the color changes of the light, the light displayed on a horizontal facet can be rapidly or gradually transformed to the light displayed on a vertical facet. By using a multi-dimensional and multi-directional structure, the adjacent area between any two neighboring facets can display the light that shows neither overlapping nor discrepancy.

The secondary object of the present invention is to provide a large-area and full color illuminator. When each facet of a transparent multi-facet case corresponds to a plurality of light sources, that facet can be divided into a plurality of smaller sub-facets. Each smaller sub-facet corresponds to a light source, which can be adjusted by the controller so that all the sub-facets of a facet can display various light patterns. This, combined with other facets can create more varieties of light patterns.

Another object of the present invention is to provide a multi-facet illuminator for an exhibition case. The exhibition case having the illuminator can be a simple cube, and each facet of the cube can independently or synchronously display various light and patterns, for example, any triangle, diamond, or hexagon. Alternatively, a large-area facet can be divided into a plurality of sub-facets, and each sub-facet corresponds to a single light source that is adjusted by the controller to display various patterns. This exhibition case can be used as floor light, tile, ceiling, wall screen/divider, bed head set, or display stand.

To achieve the aforementioned objects, the present invention provides a transparent case having a plurality of facets. The interior of the transparent case corresponding to each facet is divided into a plurality of independent areas. Each independent area has a light source module, and each light source module is composed of at least two colors of light-emitting elements. A controller is used to control the output of the light sources so that each facet can display various visual lights to accomplish different effects.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
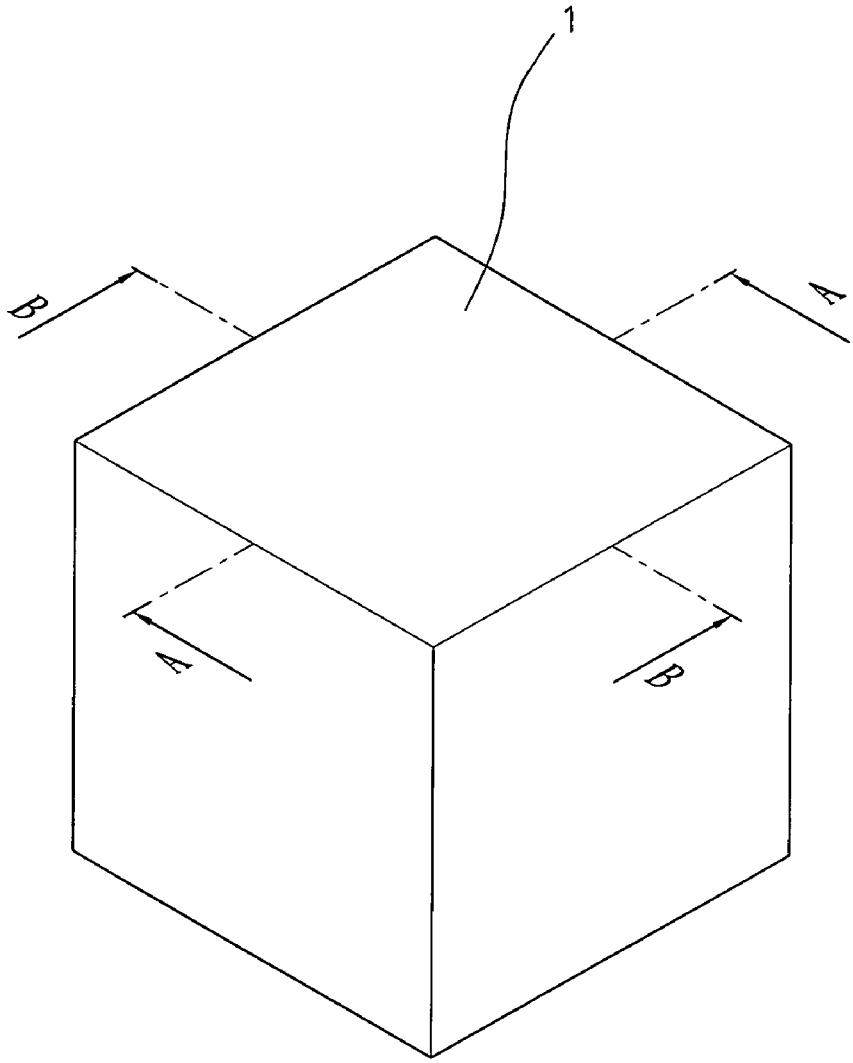
FIG. 1 shows a three-dimensional view of the invention.
Figure 2A:
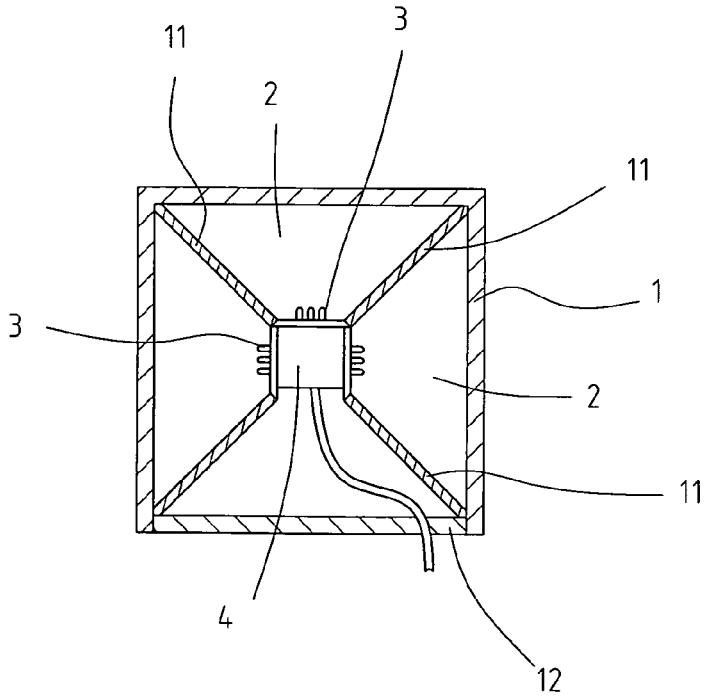
FIG. 2A shows a cross-sectional view along the AA facet of the structure shown in FIG. 1.
Figure 2B:
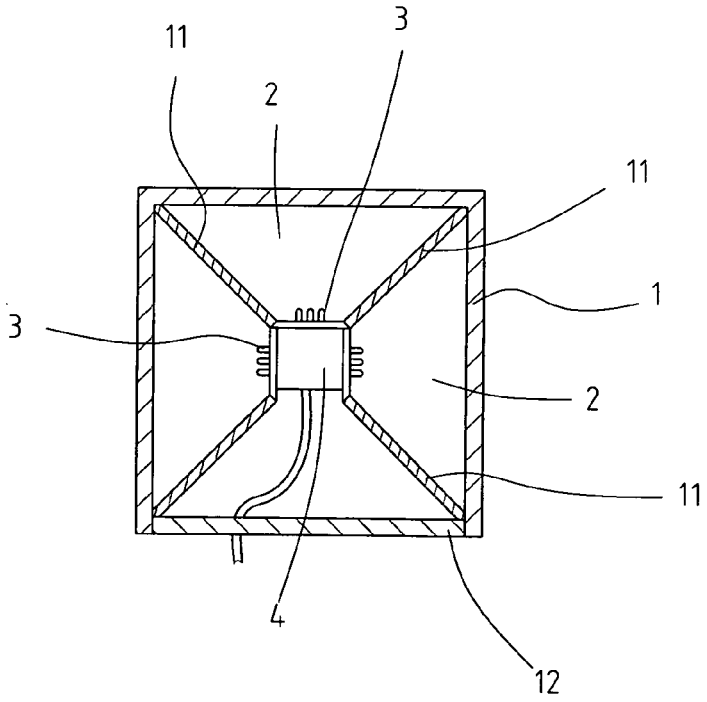
FIG. 2B shows a cross-sectional view along the BB facet of the structure shown in FIG. 1.

As shown in FIG. 1, FIG. 2A and FIG. 2B, the present invention is a multi-facet full color illuminator, including a case 1, a plurality of separated areas 2 inside case 1, a plurality of separators 11 for separating separated area 2 and shared by two adjacent separated areas 2, a light source module 3 inside each separated area 2, each light source module 3 having at least two elements capable of emitting different colors of light, and a controller 4 for adjusting the electric current to control the brightness of each light source module 3.

In the present embodiment, case 1 is a cube, or a three-dimensional rectangle. Case 1 is hollow to house separators 11 and light source modules 3. A bottom 12 is used to seal the aforementioned components inside case 1.

Figure 3:
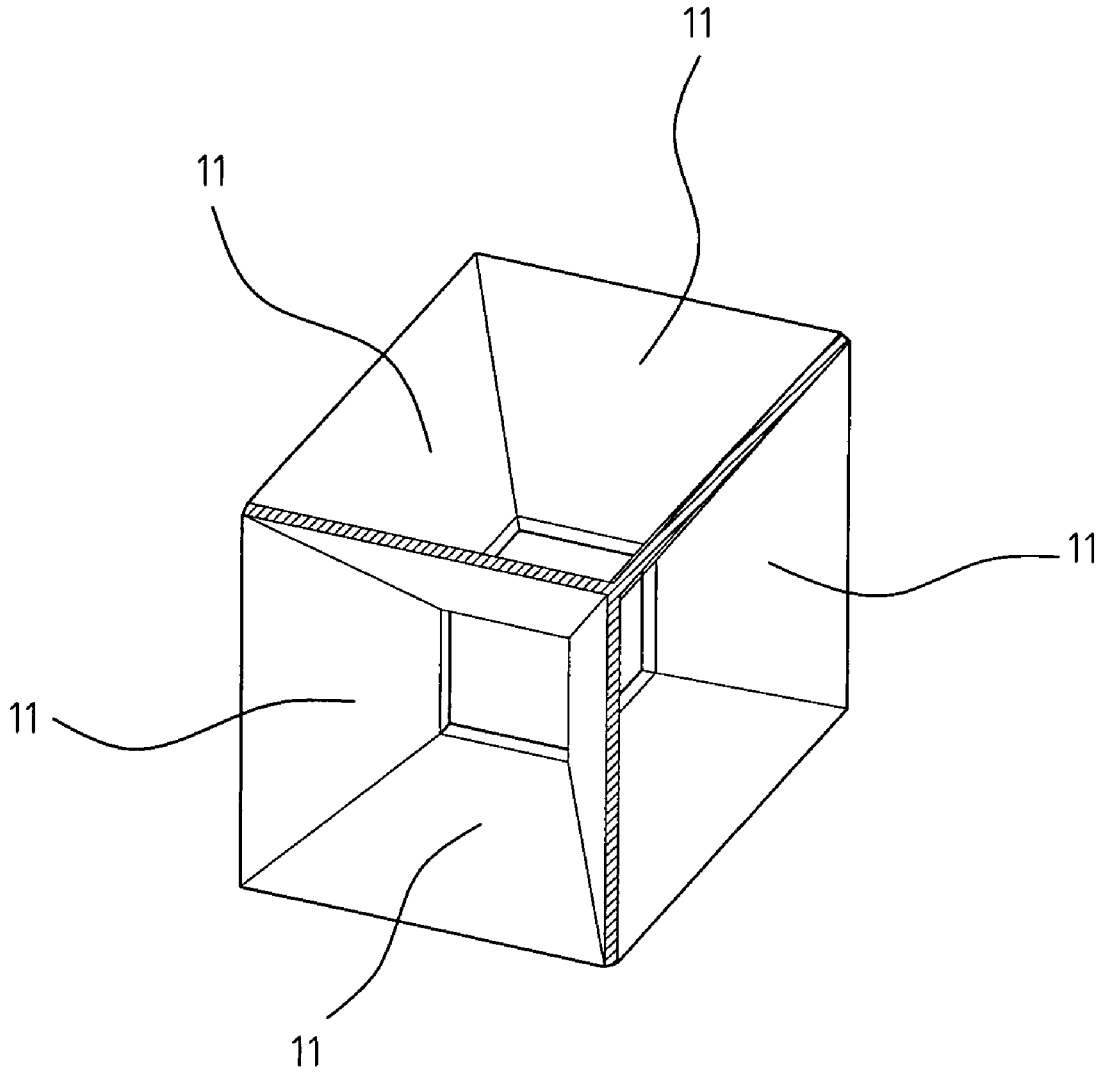
FIG. 3 shows a three-dimensional schematic view of separators of the present invention.

Each separated area 2 is formed by a plurality of separators 11 installed inside case 1. Generally, a separated area 2 is formed by four separators 11, in a shape of a funnel, as shown in FIG. 3. The wider end of the funnel is attached to one facet of case 1, and the narrower end of the funnel is installed with a light source module 3, as shown in FIG. 2A and FIG. 2B. Two adjacent separated areas 2 share a separator 11. The separators can be manufactured as a monolithic structure so that, when placed inside case 1, a plurality of separated areas 2 is formed.

Light source module 3 includes at least two light-emitting elements, with each being able to emit a different color of light. The light-emitting element can be a light-emitting diode (LED), a light bulb having a color glass case, or an ordinary light bulb with a color shade. By adjusting the current, the brightness of the light-emitting elements of the light source module is controlled. In the present embodiment, light source module 3 includes a red LED, a blue LED and a green LED. However, light source module 3 can also include an array consisting of a plurality of different color LEDs, or a single or a plurality of LEDs capable of emitting different lights. Controller 4, shown as a block in FIG. 2A and FIG. 2B, is installed inside case 1. Controller 4 includes a control circuit and is wired to each light source module 3 to control the brightness or illumination pattern.

In summary, by varying the current to control the color and the brightness of light of light source module 3 in each separated area 2 inside case 1, each facet of case 1 can display various color patterns and brightness independently to generate dynamic and interesting light exhibition.

Figure 4:
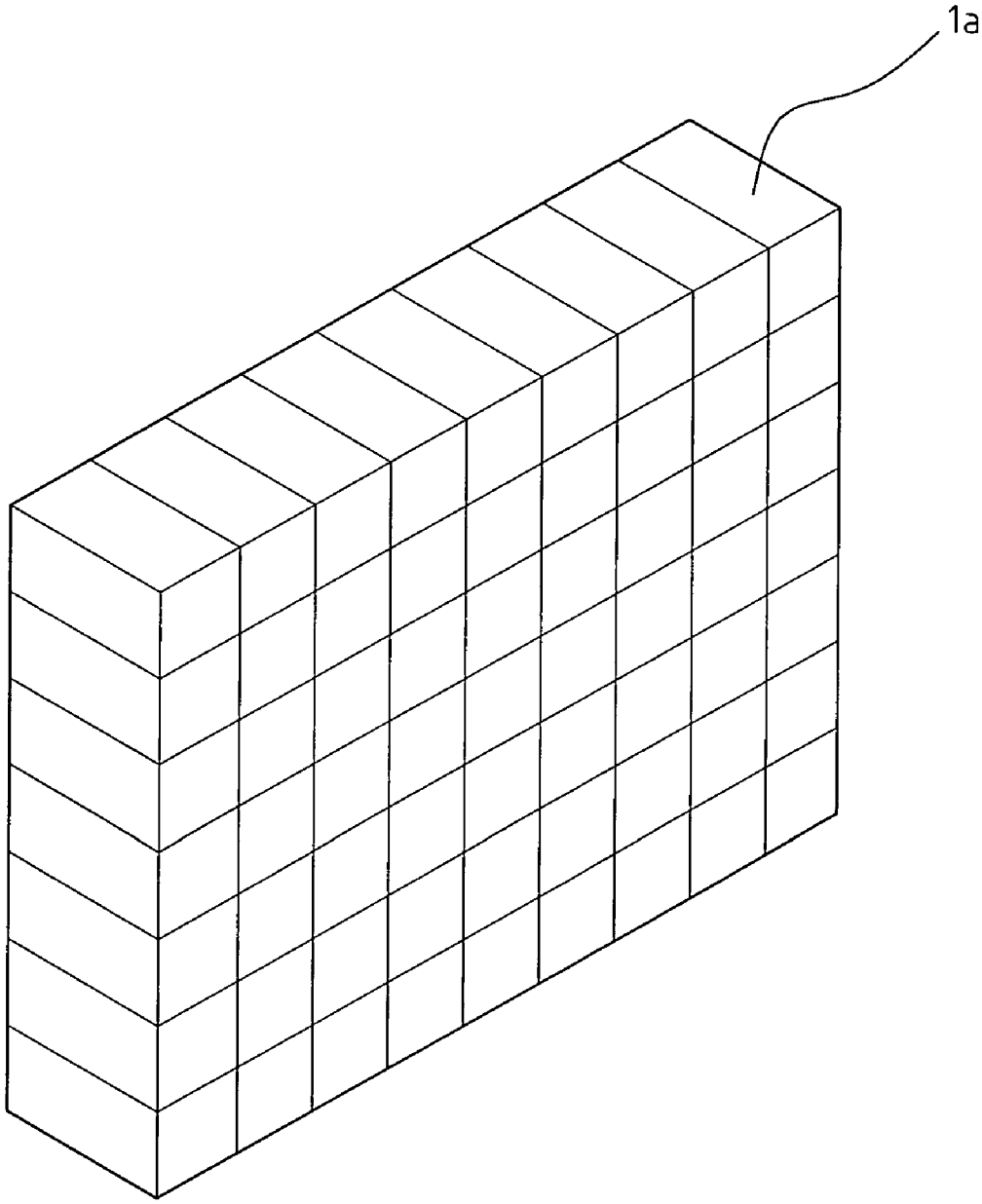
FIG. 4 illustrates a three-dimensional view of another embodiment according to the invention.
Figure 5:
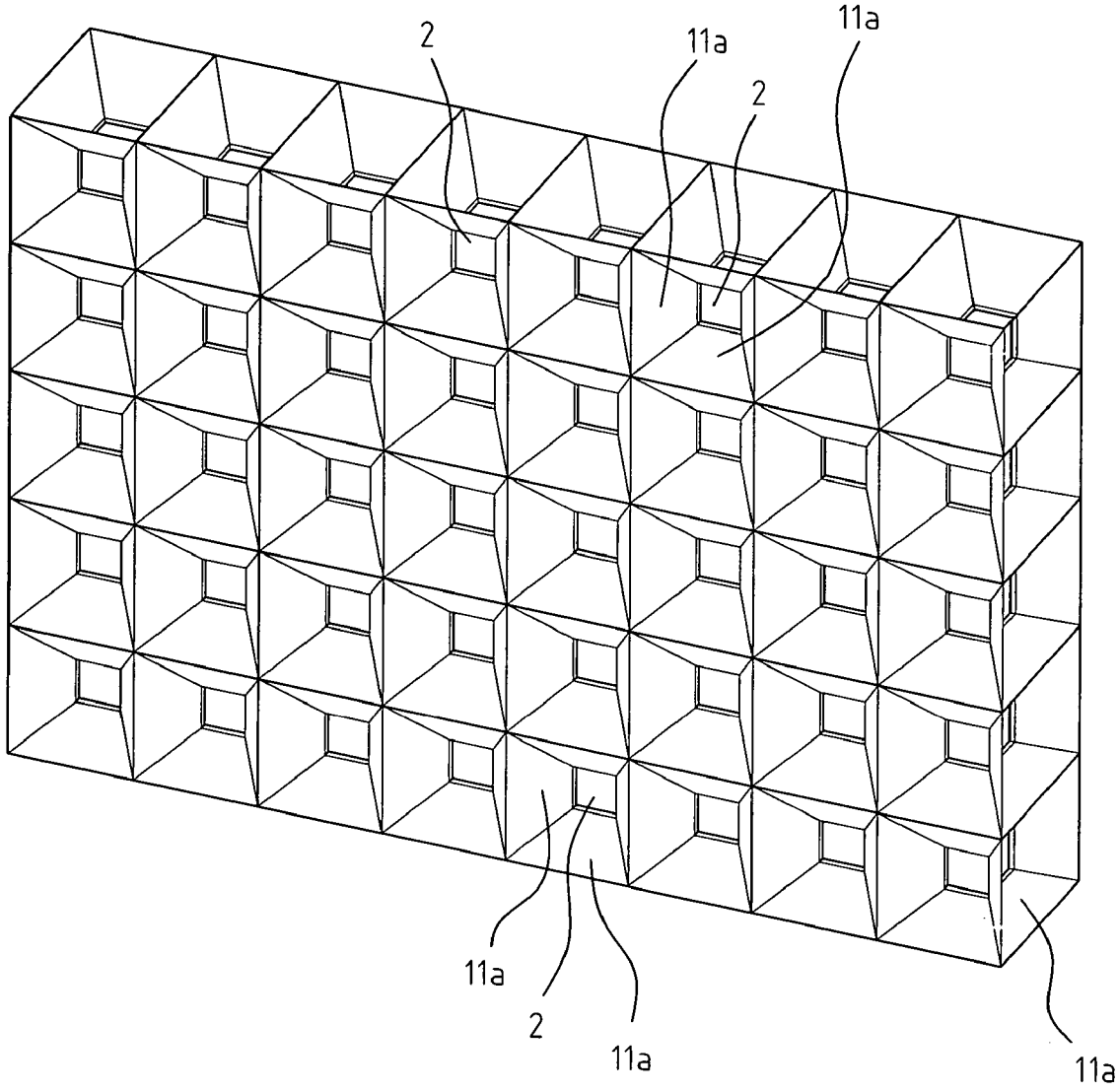
FIG. 5 shows a schematic view of the structure after taking off case 1*a* of the embodiment illustrated in FIG. 4.
Figure 6:
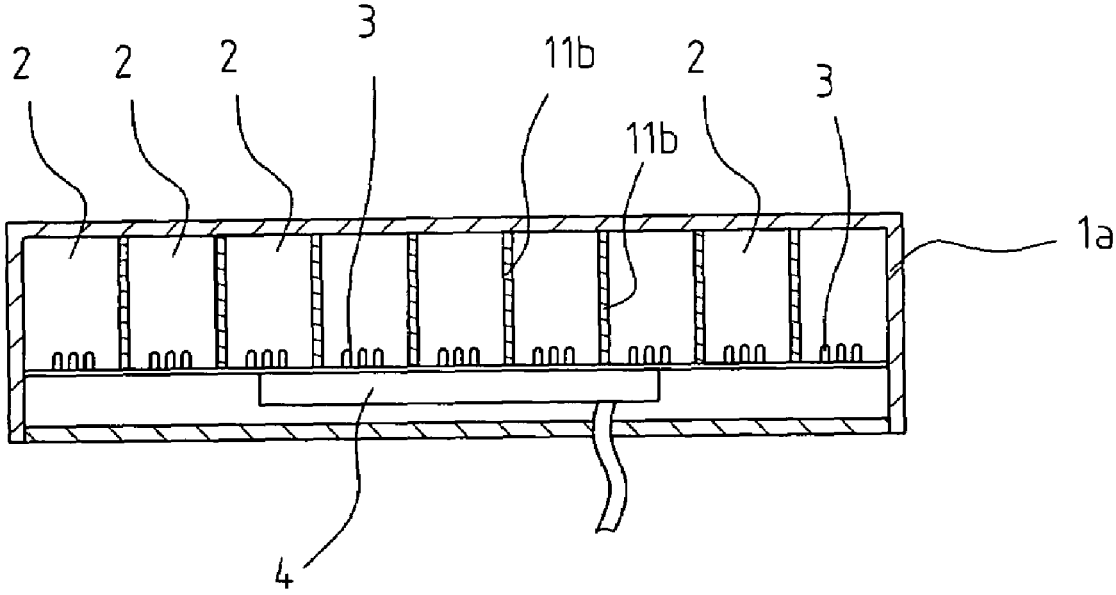
FIG. 6 shows a cross-sectional view of structure having a plurality of separators of the embodiment illustrated in FIG. 4.

FIG. 4 and FIG. 5 show another embodiment of the present invention. A case 1*a* is a large-area three-dimensional rectangle. Inside case 1*a*, a plurality of small-area separated areas 2, shaped as a funnel, are formed by a plurality of separators 11*a*. A light source module (not shown) is installed in each separated area 2. A separated area 2 corresponds to an area on case 1*a* enclosed by the dash line in FIG. 4. The controller is installed inside case 1*a* and connected to all the light source modules. As shown in FIG. 6, the cross-sectional view shows that a plurality of separators 11*b* form a plurality of small-area separated areas 2, with each corresponding to an area on case 1*a* enclosed by the dash line in FIG. 4. Using the above structure, a large-area display for exhibition can be formed. Each small-area separated area 2 of the large-area display can freely change the color and the brightness of the light by using a controller 4 so that a variety of colorful light patterns can be generated and exhibited.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-facet full color illuminator, comprising:

a transparent case having a plurality of facets;

a controller located at the center of said transparent case and having a plurality of surfaces for mounting a plurality of light source modules, each light source module comprising at least one light-emitting element; and a plurality of separators each connecting an edge jointing two surfaces of said controller and an edge jointing two facets of said transparent case for forming a plurality of separated areas inside said transparent case;

wherein said controller controls electric current to the light-emitting elements of said light source modules to adjust brightness and color of the light emitted by each of the light-emitting elements.

2. The illuminator as claimed in claim 1, wherein each of said light source modules comprises a plurality of single-color light-emitting elements.

3. The illuminator as claimed in claim 1, wherein each of said light source modules comprises a single or a plurality of light-emitting elements, and each of said light-emitting elements emits two or more color of lights.

4. The illuminator as claimed in claim 1, wherein said transparent case is a three-dimensional hollow body with multiple facets, and each of said separated areas is covered by one of said multiple facets.

5. The illuminator as claimed in claim 4, wherein each of said separated areas has a funnel-like shape and is enclosed by a plurality of said separators, one of said surfaces of said controller and a corresponding facet of said transparent case.

* * * * *